United States Patent [19]

Hengelmolen

[11] Patent Number: 5,029,533

[45] Date of Patent: Jul. 9, 1991

[54] PRESSURE RELIEF MECHANISM

[75] Inventor: Adrianus J. Hengelmolen, Dreumel, Netherlands

[73] Assignee: Copermill Limited, Nottingham, United Kingdom

[21] Appl. No.: 471,107

[22] Filed: Jan. 26, 1990

[30] Foreign Application Priority Data

Feb. 4, 1989 [GB] United Kingdom ..... 8902497

[51] Int. Cl.[5] ..... F23M 11/00; F23M 7/00

[52] U.S. Cl. ..... 110/181; 110/173 R; 110/173 B; 110/176; 49/141

[58] Field of Search ..... 110/173 R, 173 B, 176, 110/181; 34/51; 49/141

[56] References Cited

U.S. PATENT DOCUMENTS

| | | | |
|---|---|---|---|
| 1,944,156 | 1/1934 | Feltham | 110/173 B |
| 2,426,084 | 8/1947 | Deloghia | 110/181 X |
| 2,735,386 | 2/1956 | Longenecker | 110/176 |
| 3,127,891 | 4/1964 | Henneman et al. | 137/488 X |
| 3,410,288 | 11/1968 | Hajek | 110/173 B |
| 3,730,214 | 5/1973 | Brumm | 137/488 |
| 4,327,241 | 4/1982 | Obenchain | 110/173 B |

*Primary Examiner*—Henry A. Bennett
*Assistant Examiner*—C. Kilner
*Attorney, Agent, or Firm*—Paul & Paul

[57] ABSTRACT

A safety door for a furnace or like apparatus is operable to open under the force of a hydraulic cylinder when the pressure under the furnace exceeds a predetermined upper limit corresponding to an abnormally high pressure caused by an explosion within the furnace or like apparatus. The safety door thereby prevents the furnace from being permanently damaged by an explosion.

3 Claims, 2 Drawing Sheets

PRESSURE RELIEF MECHANISM

The present invention relates to safety apparatus and more particularly for relieving excessive pressure in a boiler, furnace or similar system.

Boiler systems normally operate at a pressure which is above atmospheric and they are designed to withstand such pressure. Recent designs of furnaces, particularly those which are effective in pollution control may also operate at pressure and/or may have clamping control "valve" arrangements which can, if they malfunction, cause a sudden build up of pressure within the furnace.

Known safety devices comprise a weakened section of a boiler which is capable of withstanding normal pressures but which will "blow" open if the pressure rises to above a set safety limit. In boilers this may comprise a weakened wall section and in furnaces this may comprise a thinner thermal wall forming a weakened "window".

There are a number of disadvantages with respect to this known safety system among which are that the system is not able to be tested since it is effectively destroyed by any test and has to be rebuilt. Also, the system is found not to be very effective in dealing with extremely rapid rises in pressure such as an explosion within the boiler or furnace. Additionally once "blown" the safety device has to be carefully reconstructed and this is normally only able to be done by skilled craftsmen.

It is an object of the present invention to provide safety apparatus for a furnace or boiler or like system hereinafter referred to as a furnace which is readily testable, and which is easily reset and which is able to respond to extremely rapid rises in interval pressure such as caused by an explosion.

According to the present invention there is provided safety apparatus for a furnace including a door which is normally sealed closed against a portion of the furnace wall and including hydraulic cylinder means operative in response to a rapid build up of pressure within the furnace to open the door.

Preferably the door or a mounting holding the door is pivotably mounted and two hydraulic cylinders are attached to the opposite end of the door, or mounting, to the pivot.

Preferably the hydraulic cylinders are double acting thereby providing in normal operation hydraulic force to maintain the door in a sealed condition and providing hydraulic power to force open the door when a sudden rise in pressure within the furnace is detected.

Preferably a gas actuated control member is connected to the furnace and to the hydraulic supply line to the hydraulic cylinder which control member is operative to detect a pressure within the furnace above a safe operating pressure and to switch the hydraulic supply to the hydraulic cylinder to cause the door to be opened under hydraulic pressure.

Figure 1:
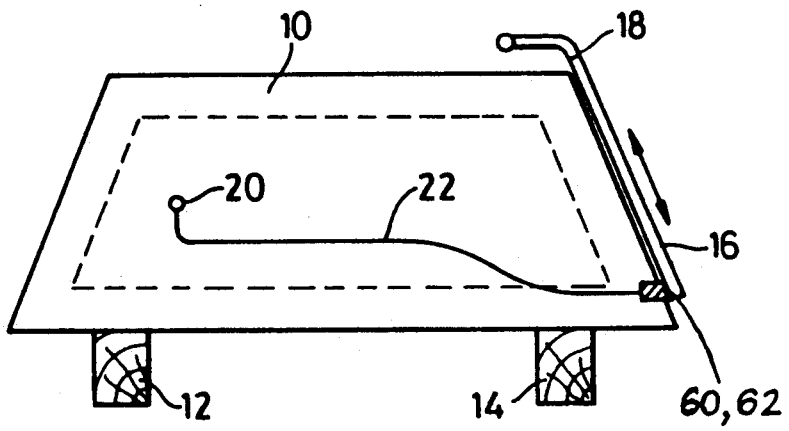
Figure 2:
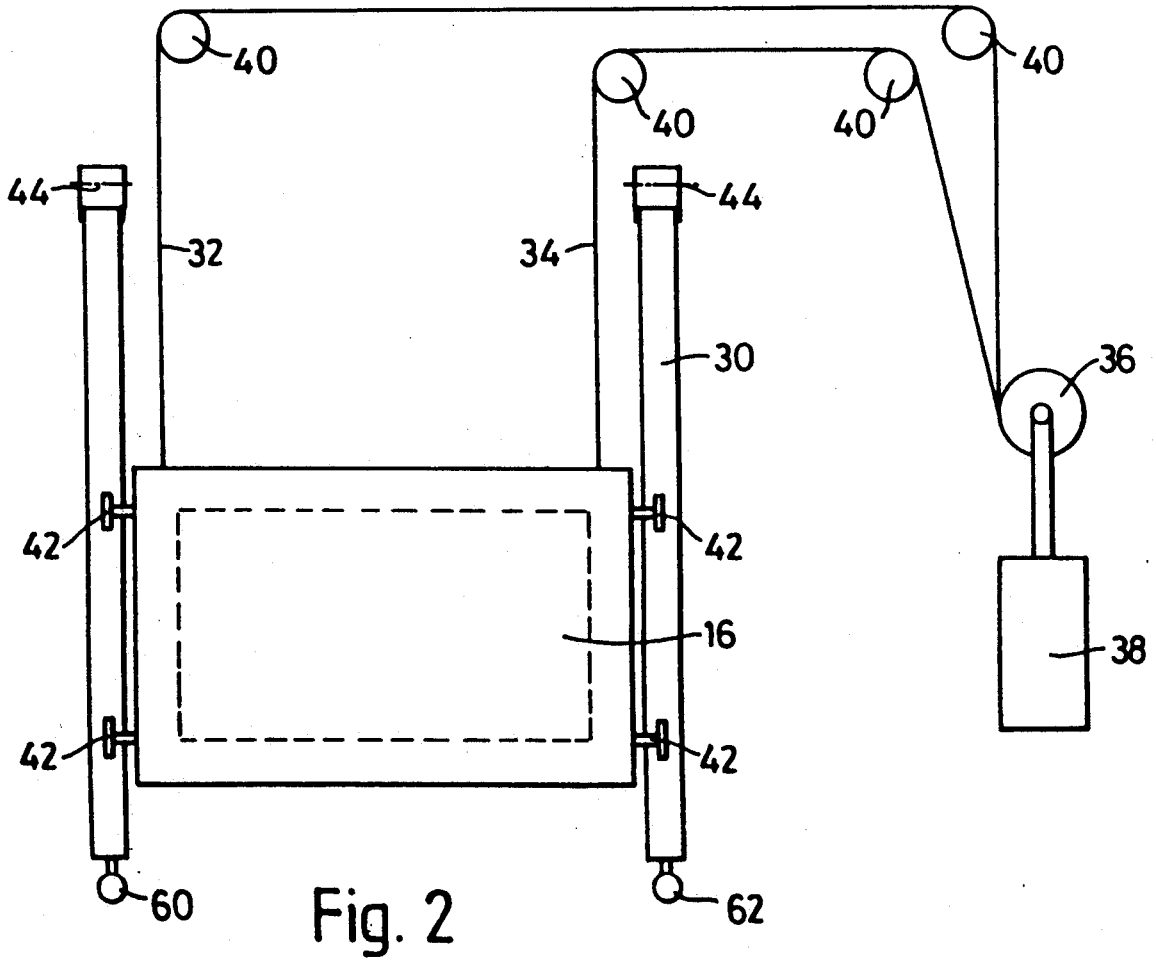
Figure 3:
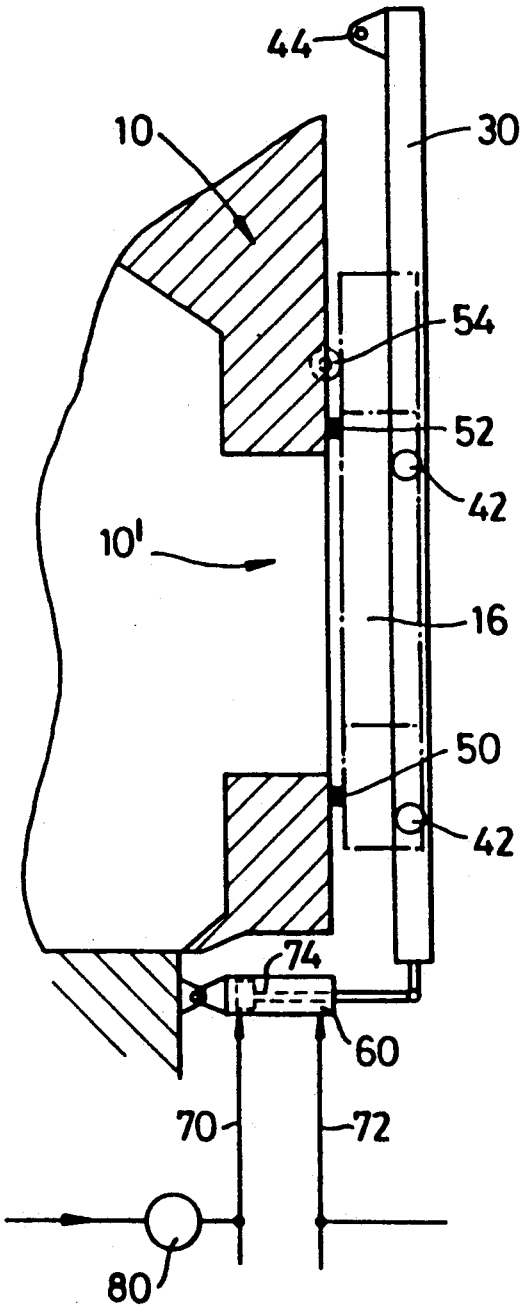

Embodiments of the present invention will now be disclosed, by way of example with reference to the accompanying drawings, in which:

FIG. 1 schematically illustrates a furnace with safety apparatus according to the present invention;

FIG. 2 shows diagrammatically the safety apparatus of FIG. 1 in front elevation; and FIG. 3 diagrammatically shows the safety apparatus of FIG. 2 in side elevation.

With reference now to FIG. 1 a furnace 10 is shown the furnace being mounted on suitable pillars 12, 14. The design of the furnace is immaterial to the invention and as stated hereinbefore the safety apparatus can be used on boilers or spray driers or any similar apparatus which is subject to the possibility of internal explosions. Thus the furnace is only exemplary but the invention is particularly applicable to furnaces since these are often subject to explosions especially if used to burn or melt scrap material.

The furnace 10 is provided with a door 16 which is normally liftable by means 18 described in greater detail in FIG. 2.

The pressure within the furnace 10 is detected by a detector 20 and a "signal" is fed via connection 22 to one or more hydraulic actuating cylinders 60, 62. The connection 22 may be electronic if the furnace is electronically controlled or may be hydraulic or gas pressure operated.

With reference to FIGS. 2 and 3 the door 16 is, in this example, slidably mounted on a frame 30 and is liftable by means of wire ropes 32, 34 which are attached to a winding drum 36 driven by motor 38 and passover guide pulleys 40. Door 16 is therefore slidable on rollers 42 to enable feed material to be put into furnace 10.

Frame 30 is pivotted at its upper end on pivots 44 which are attached to suitable hinges on the main frame of the furnace 10. The door 16 when lowered into its closed position as shown is sealed by seals 50, 52, which surround the door. An upper roller 54 may also be provided which may act as a guide roller for the door when being raised and lowered to prevent the door from hitting the upper part of the seal 52.

At the bottom of frame 30 there are attached the operating rods of two hydraulic cylinders 60, 62 which are anchored or attached (FIG. 3) to part of the main frame of the furnace. The cylinders 60, 62 are preferably of the double acting type with two inlets 70, 72 on either side of piston 74. In known manner hydraulic fluid pressure, applied on inlet 72 will cause the piston 74 to move to the left and on inlet 70 will cause the piston 74 to move to the right respectively closing and opening door 16.

Normally when the furnace is operative piston 74 is in the position shown in FIG. 3 and it is moved only when there is excessive pressure inside furnace 10 or when it is required to open door 16.

In the latter case by gradually shutting off the hydraulic pressure on inlet 72 the door 16 will be allowed to release from the seals 50, 52 and may then be lifted. Scrap metal or other material to be melted or burnt may then be loaded into the furnace and door 16 lowered again. Returning pressure to inlet 72 will then force the door 16 back against seals 50, 52 thereby sealing the opening 10, in furnace 10. Inlet 70 can be used to provide pressure to actually force open door 16 if required but this may not be necessary.

If pressure inside furnace 10 rises rapidly then this is transmitted to control 80 which reacts to any rapid rise in air pressure to provide a large increase in hydraulic pressure on inlet line 70 and thereby to force piston 74 to move rapidly to open door 16.

The principal advantages of this apparatus are that it is possible to test the apparatus by causing an explosion, by igniting a charge within the furnace, without damaging the furnace since the door 16 can be closed again by release of the excessive hydraulic pressure on inlet 70. Also the use of the hydraulic rams 60, 62 (62 not shown in FIG. 3 but is operative as cylinder 60) ensures a very rapid opening of door 16.

With respect to a furnace therefore the main door can be used as a safety door. With spray driers and boilers a special door suitably hinged may be required but this may be constructed from already present inspection ports.

I claim:

1. A pressure relief mechanism for a furnace, said apparatus comprising a door, said door being hingedly connected at one end thereof to said furnace to close an opening in said furnace, said door comprising seal means for sealing said opening in a gas tight manner, first and second double acting hydraulic cylinders each being respectively connected to opposite edges of the door at positions remote from the hinges, and being mounted externally of said furnace;

in which each said double acting hydraulic cylinder is operative in a first direction to supply closing pressure to the door to seal the opening in said gas tight manner, said closing pressure being sufficient to maintain the door completely sealed against pressures present within the furnace created by the combustion process within the furnace;

and including control means operative to detect a rapid rise in pressure within the furnace indicating an explosion within the furnace;

and in which the control means in connected to each said double acting hydraulic cylinder and is operative to supply a large increase in hydraulic pressure to each said double acting hydraulic cylinder in its second direction to overcome the pressure exerted by said double acting hydraulic cylinder in said first directed and to thereby force open the door thereby releasing the explosive pressure.

2. A pressure relief mechanism for a furnace as claimed to claim 1 in which the door is generally rectangular and is hinged at a top end thereof and in which the hydraulic cylinders are positioned at a bottom end thereof such that initial explosive gases are emitted at the bottom end of said door in a direction parallel to a main surface of the door and not in a direction at right angles to the main surface of the door, thereby protecting an operator from a direct blast from the explosion.

3. Safety apparatus as claimed in claim 1 in which the door is provided with roller means operative to allow the door to be moved when the cylinders are released from operating in the first direction to allow access to the furnace.

* * * * *

UNITED STATES PATENT OFFICE

CERTIFICATE OF CORRECTION

Patent No. 5,029,533 Dated 7/9/91

Inventor(s) Adrianus J. Hengelmolen

It is certified that error appears in the above-identified patent and that said Letters Patent is hereby corrected as shown below:

Column 4, Line 24, delete "direction" and substitute therefore --position--.

Signed and Sealed this

Twelfth Day of January, 1993

*Attest:*

DOUGLAS B. COMER

*Attesting Officer*

*Acting Commissioner of Patents and Trademarks*